US011608691B2

(12) United States Patent
King et al.

(10) Patent No.: US 11,608,691 B2
(45) Date of Patent: Mar. 21, 2023

(54) WIRELINE CABLE HEAD WITH WEAK LINK INCLUDING SHOCK ABSORBER

(71) Applicant: KING SOUTHWEST & CONSULTING OF CYPRESS dba KSWC, Houston, TX (US)

(72) Inventors: George R. King, Houston, TX (US); Santos D. Ortiz, Houston, TX (US)

(73) Assignee: King Southwest & Consulting of Cypress, Houston, TX (US)

( * ) Notice: Subject to any disclaimer, the term of this patent is extended or adjusted under 35 U.S.C. 154(b) by 106 days.

(21) Appl. No.: 17/207,596

(22) Filed: Mar. 19, 2021

(65) Prior Publication Data

US 2021/0301598 A1 Sep. 30, 2021

Related U.S. Application Data

(60) Provisional application No. 62/994,033, filed on Mar. 24, 2020.

(51) Int. Cl.
*E21B 17/02* (2006.01)

(52) U.S. Cl.
CPC ..... *E21B 17/023* (2013.01)

(58) Field of Classification Search
CPC ..... E21B 17/023
See application file for complete search history.

(56) References Cited

U.S. PATENT DOCUMENTS

| | | | | |
|---|---|---|---|---|
| 4,035,092 | A | 7/1977 | Adams, Jr. | |
| 4,624,308 | A * | 11/1986 | White | E21B 17/06 166/65.1 |
| 4,648,444 | A * | 3/1987 | Busch | E21B 17/07 403/2 |
| 4,697,641 | A | 10/1987 | White | |
| 4,706,744 | A | 11/1987 | Smith et al. | |
| 4,759,406 | A | 7/1988 | Smith et al. | |
| 5,109,921 | A * | 5/1992 | Aracena | E21B 17/023 166/385 |
| 5,392,851 | A | 2/1995 | Arend | |
| 7,290,748 | B2 | 11/2007 | McDonald | |
| 9,322,225 | B2 | 4/2016 | Mogedal et al. | |
| 9,869,138 | B2 | 1/2018 | Vanegas et al. | |
| 10,329,850 | B2 | 6/2019 | Nicholson | |
| 2005/0230115 | A1* | 10/2005 | Rose | E21B 31/00 166/301 |
| 2007/0023191 | A1* | 2/2007 | Dreggevik | E21B 17/028 166/242.7 |

(Continued)

*Primary Examiner* — David Carroll
(74) *Attorney, Agent, or Firm* — Smith IP Services, P.C.

(57) ABSTRACT

A cable head can include an upper connector configured to connect the cable head to a wireline, a lower connector configured to connect the cable head to a well tool, and a weak link configured to transmit tensile force between the upper and lower connectors. The weak link can include a shock absorber connected in series with a weak point. A method of connecting a wireline to a well tool can include securing the wireline to an upper end of a weak link, and securing the well tool to a lower end of the weak link. The weak link includes a wire rope, and end links secured at respective opposite ends of the wire rope. One end link includes a weak point. A weak link for use with a cable head can include a weak point and a shock absorber connected in series with the weak point.

20 Claims, 5 Drawing Sheets

(56) References Cited

U.S. PATENT DOCUMENTS

| | | | | |
|---|---|---|---|---|
| 2008/0053654 | A1* | 3/2008 | Ullah | E21B 47/135 166/250.1 |
| 2012/0132439 | A1* | 5/2012 | Ratcliffe | E21B 17/021 166/377 |
| 2016/0177702 | A1* | 6/2016 | Buck | G01V 11/002 166/242.6 |
| 2018/0038169 | A1 | 2/2018 | Nicholson | |
| 2021/0062589 | A1* | 3/2021 | Kennedy | E21B 17/023 |

* cited by examiner

WIRELINE CABLE HEAD WITH WEAK LINK INCLUDING SHOCK ABSORBER

BACKGROUND

This disclosure relates generally to equipment utilized and operations performed in conjunction with a subterranean well and, in an example described below, more particularly provides a wireline cable head with a weak link that includes a shock absorber.

A cable head can be used to secure a wireline to a well tool string. In this way, the wireline can be used to convey the well tool string through a borehole. In some cases the cable head can include a weak link that will part prior to the wireline parting, so that the wireline can be retrieved, in the event that the tool string becomes stuck in the borehole.

It will, therefore, be readily appreciated that improvements are continually needed in the art of designing, constructing and utilizing cable heads for use in subterranean wells. It is among the objects of the present disclosure to provide such improvements to the art.

DETAILED DESCRIPTION

Figure 1:
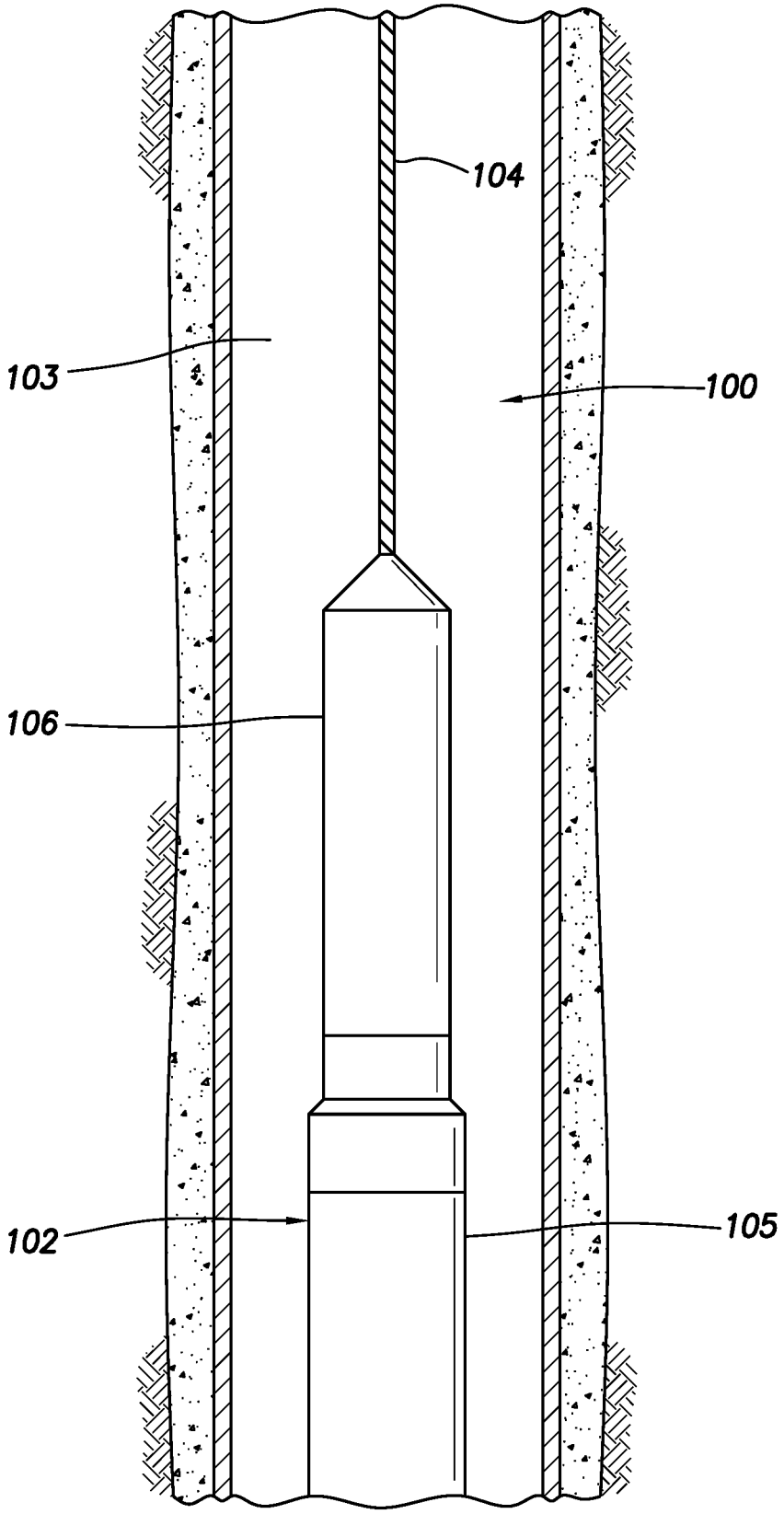
FIG. 1 is a representative partially cross-sectional view of an example of a well system and associated method which can embody principles of this disclosure.

Representatively illustrated in FIG. 1 is a system 100 for use with a subterranean well, and an associated method, which can embody principles of this disclosure. However, it should be clearly understood that the system 100 and method are merely one example of an application of the principles of this disclosure in practice, and a wide variety of other examples are possible. Therefore, the scope of this disclosure is not limited at all to the details of the system 100 and method as described herein and/or depicted in the drawings.

In the FIG. 1 example, a downhole well tool string 102 is suspended in a borehole 103 by a wireline 104. The wireline 104 could be any type of cable or electrical line capable of conveying and supporting the tool string 102 in the borehole 103. Suitable types of wirelines include armored cable with one or more electrical conductors therein, an "e-line" or electrical line, a slick line, etc. The scope of this disclosure is not limited to use of any particular type of wireline in the system 100.

The tool string 102 may be any type of tool string, and may be deployed in the borehole 103 for any purpose (such as, logging, perforating, fishing, packer or bridge plug setting, etc.). The scope of this disclosure is not limited to any particular type of tool string used in the system 100, or to any particular purpose or function of the tool string.

The tool string 102 in the FIG. 1 example includes at least one well tool 105. The well tool 105 may be any type of well tool (such as, a logging tool, a perforating gun, a fishing tool, a setting tool, etc.) or any combination of well tools. The scope of this disclosure is not limited to any particular type of well tool used in the system 100, or to any particular purpose or function of the well tool.

The FIG. 1 tool string 102 also includes a cable head 106. The cable head 106 mechanically connects the wireline 104 to the well tool 105. In some examples, the cable head 106 may also serve to electrically connect the well tool 105 to one or more electrical conductors of the wireline 104.

If the tool string 102 should become stuck in the borehole 103, it would be desirable to be able to retrieve the wireline 104 from the borehole, so that subsequent fishing operations could be performed to retrieve the tool string, without the wireline interfering with the fishing operation. For this purpose, the cable head 106 includes a weak link that is designed to part or separate when a predetermined tensile force is applied to the weak link.

Thus, in the event that the tool string 102 becomes stuck in the borehole 103, the predetermined tensile force can be applied to the cable head 106 (such as, by pulling up on the wireline 104 at surface). The weak link in the cable head 106 will then part, thereby allowing the wireline 104 (and a portion of the cable head) to be retrieved from the borehole 103.

In many well operations, the tool string 102 may be subjected to shock loads. For example, in perforating operations, detonation of explosive perforating charges can produce severe shock loading. As another example, when setting a packer or plug, a propellant may be ignited and then a tensile member may be parted upon completion of the setting operation to release the setting tool from the packer or plug.

Therefore, it is desirable for the weak link used in the cable head 106 to be able to withstand shock loads imparted to it during well operations (such as, but not limited to, perforating and packer or plug setting operations). The cable head 106 is provided with such a weak link, as described more fully below.

In one example, the weak link includes a wire rope that serves as a shock absorber. Various sizes of wire rope may be used (such as, ⅛" diameter having a 2000 lb. tensile strength, 5/32" diameter having a 3000 lb. tensile strength or 3/16" diameter having a 4500 lb. tensile strength). Of course, other sizes and tensile strengths may be used in various examples. As used herein, the term "wire rope" includes wire rope, wire cable, braided wire and various types of woven wire products that are sufficiently strong and tough but yield-able to absorb shock loads.

The weak link is shock resistant in the cable head 106. The wire rope acts as a shock absorber in the weak link. In contrast, a rigid weak link can fail under shock loading that the wire rope would be able to withstand without breaking.

In an example described below, the weak link includes both the wire rope and a rigid weak point connected in series. The wire rope serves as a shock absorber to protect the rigid weak point from failure due to shock loading, and the rigid weak point is designed to part at a predetermined tensile force. The wire rope, therefore, has a greater tensile strength than the rigid weak point.

The weak link in this example includes the wire rope with rigid connectors or end links swaged on respective opposite ends of the wire rope. In other examples, the rigid connectors could be brazed, welded or otherwise secured to the opposite ends of the wire rope. One of the end connectors or links (e.g., comprising the rigid weak point) will part at a tensile force less than a tensile strength of the wire rope. The wire rope acts as a shock absorber connected in series with the end link.

Figure 2:
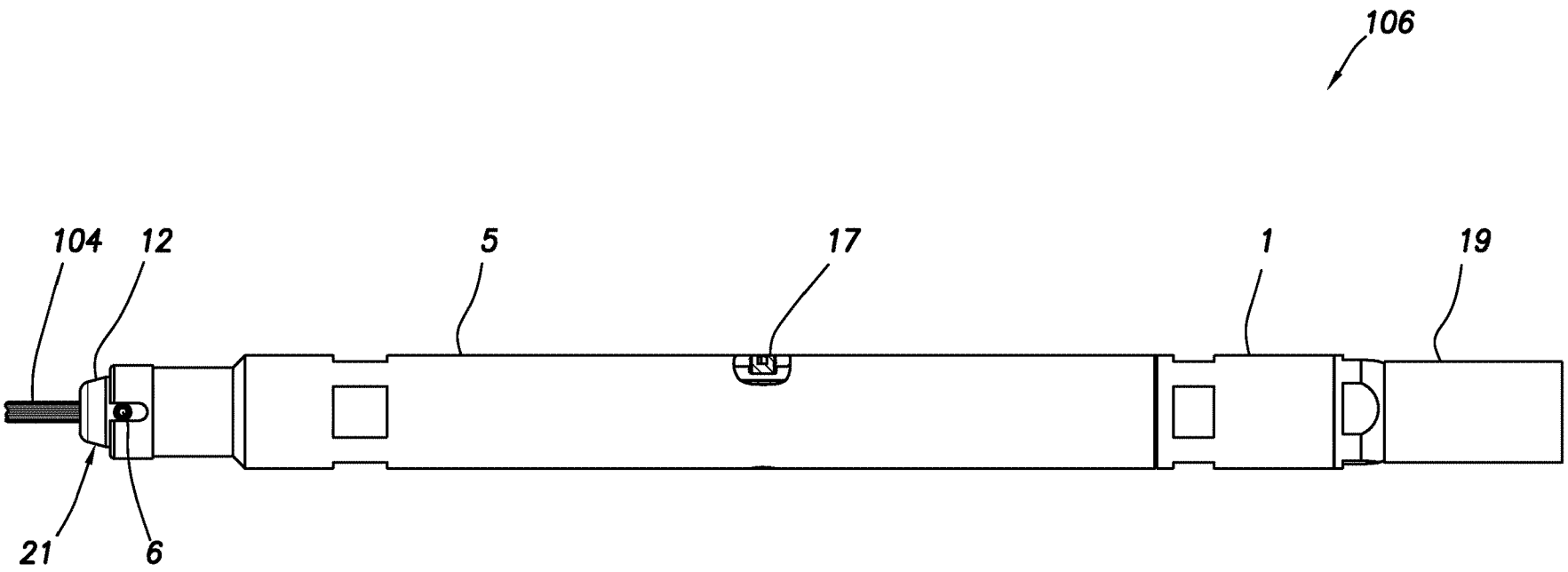
FIG. 2 is a representative side view of an example of a cable head that may be used in the system and method of FIG. 1.
Figure 3:
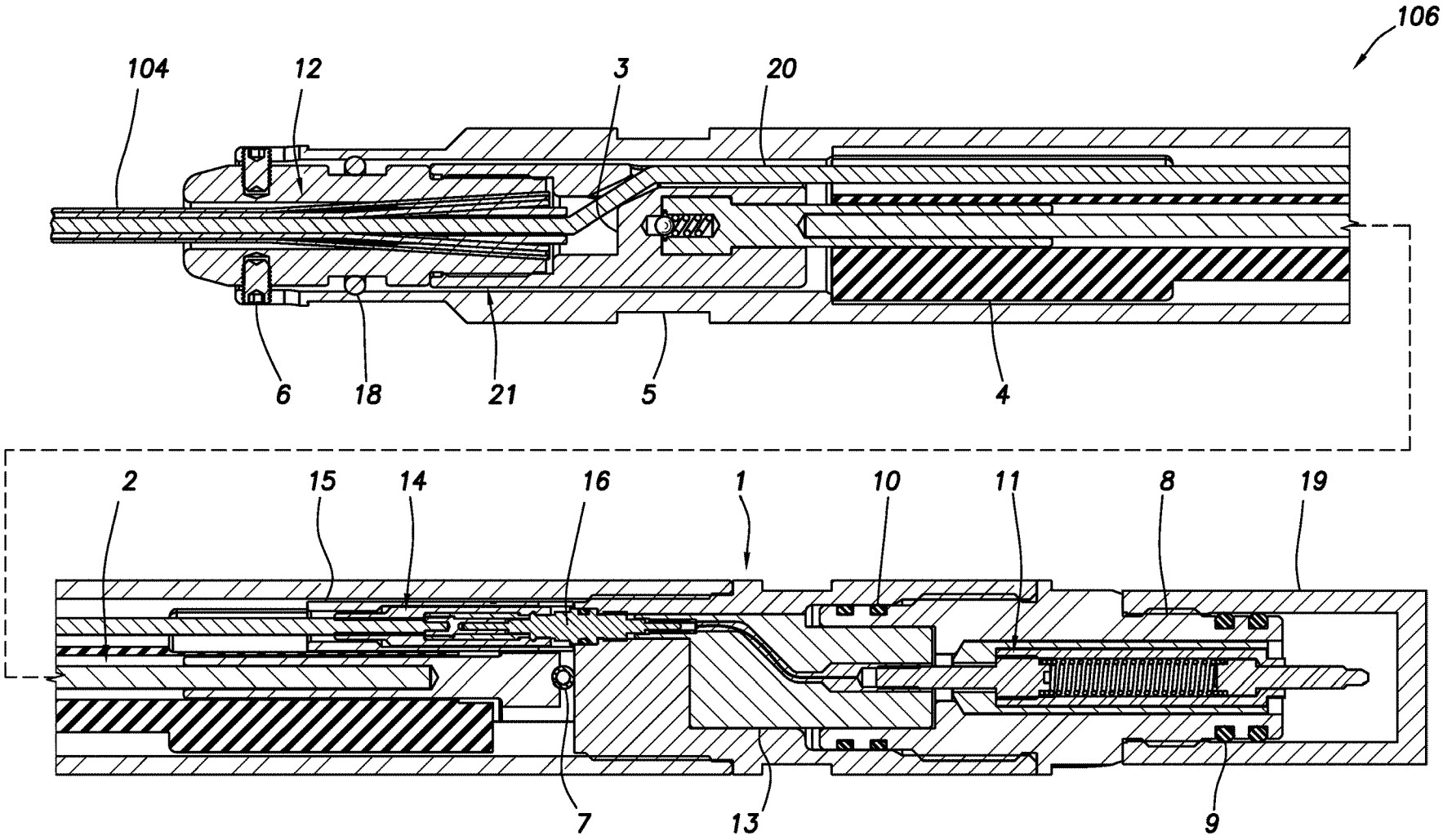
FIG. 3 is a representative cross-sectional view of the cable head.

Referring additionally now to FIGS. 2 & 3, an example of the cable head 106 is representatively illustrated. A side view of the cable head 106 is depicted in FIG. 2, and a cross-sectional view of the cable head is depicted in FIG. 3.

In the FIGS. 2 & 3 example, the cable head 106 includes a lower adapter 1, the weak link 2, a cap 3, a rubber insert 4, an outer housing 5, set screws 6, a slotted spring pin 7, a lower connector 8, o-ring seals 9, 10, an electrical connector assembly 11, a stinger assembly 12, an electrical connector 13, a boot assembly 14, a cover sleeve 15, an electrical feed-through 16, a plug 17, a ground spring 18 and a threaded protector 19. However, it should be clearly understood that, in other examples, the cable head 106 could include more or fewer components, different components, and/or different combinations of components, in keeping with the principles of this disclosure.

An upper end of the weak link 2 is retained in the cap 3, which is secured to the stinger assembly 12. In use, the wireline 104 is secured to the stinger assembly 12. The cap 3 and the stinger assembly 12 together form an upper connector 21 that in use secures the wireline 104 to the upper end of the weak link 2. Thus, tensile force applied to the wireline 104 is transmitted via the upper connector 21 to the upper end of the weak link 2.

A lower end of the weak link 2 is secured to the lower adapter 1. The lower adapter 1 is connected to the lower connector 8. In use, the lower connector 8 is secured to an upper end of the well tool 105 in the FIG. 1 system 100 (the threaded protector 19 is removed prior to attaching the well tool to the lower connector). Thus, tensile force applied via the weak link 2 is transmitted from the wireline 104 to the well tool 105.

In the FIGS. 2 & 3 example, the wireline 104 includes at least one electrical conductor 20. The electrical conductor 20 extends through the outer housing 5 from the wireline 104 in the stinger assembly 12 to the electrical feed-through 16. The connector assembly 11 provides for electrical connection to the well tool 105 connected below the cable head 106.

Figure 4:
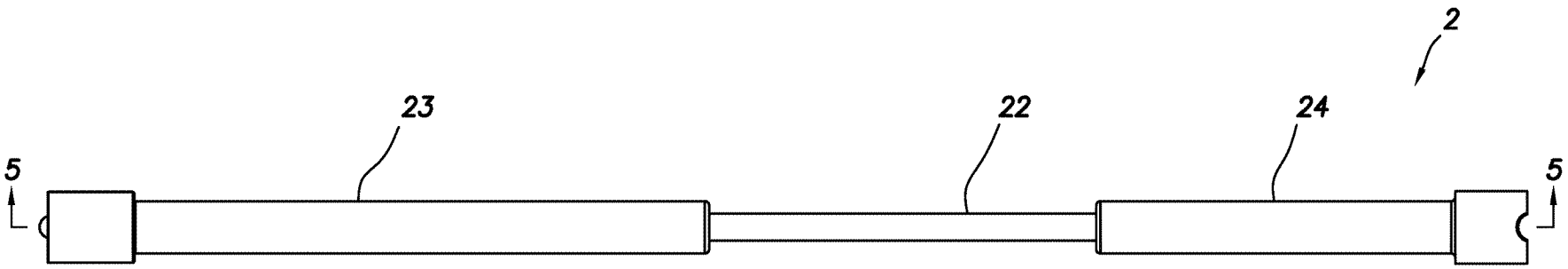
FIG. 4 is a representative side view of an example of a weak link that may be used in the cable head.
Figure 5:
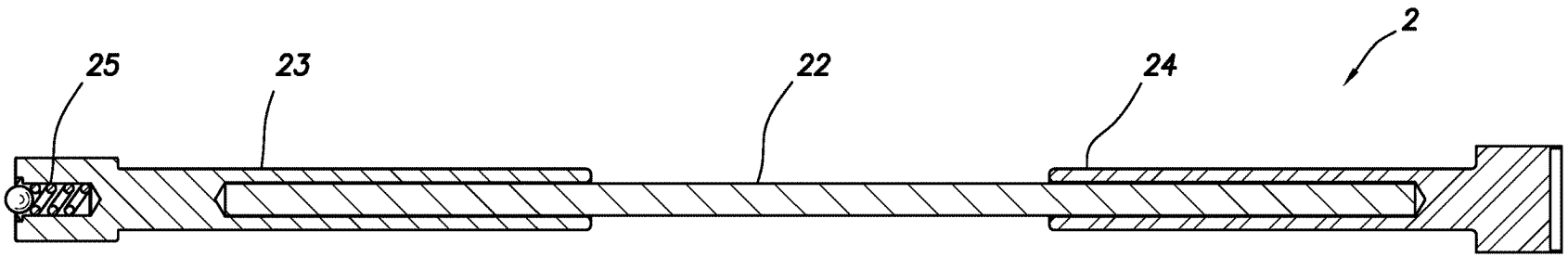
FIG. 5 is a representative cross-sectional view of the weak link.

Referring additionally now to FIGS. 4 & 5, an example of the weak link 2 is representatively illustrated. FIG. 4 depicts a side view of the weak link 2, and FIG. 5 depicts a cross-sectional view of the weak link.

In this example, the weak link 2 includes a wire rope 22 connected between an upper end link 23 and a lower end link 24. A ball and spring plunger 25 ensures electrical grounding of the weak link 2 to the remainder of the cable head 106 (for example, in the cap 3).

The upper and lower end links 23, 24 are swaged onto the wire rope 22 in the FIGS. 4 & 5 example. In other examples, the end links 23, 24 could be mechanically connected to opposite ends of the wire rope 22 using other techniques (such as, soldering, welding, fastening, bonding, etc.). Thus, the scope of this disclosure is not limited to any particular construction or combination of components in the weak link 2.

The upper end link 23 includes a weak point in this example. The upper end link 23 is designed to have a tensile strength that is less than that of the wire rope 22 and less than that of the lower end link 24. In this manner, a lower portion of the upper end link 23, the wire rope 22 and the lower end link 24 will remain in the cable head 106 when the upper end link parts in response to a predetermined tensile force being applied to the weak link 2.

Note that the upper portion of the upper end link 23, the cap 3 and the stinger assembly 12 will be retrieved from the borehole 103 with the wireline 104 after the upper end link parts. Prior to the upper end link 23 being parted, the wire rope 22 will serve to dampen any shock loads applied to the weak link 2, due to the wire rope and the end links 23, 24 being connected in series.

Figure 7:
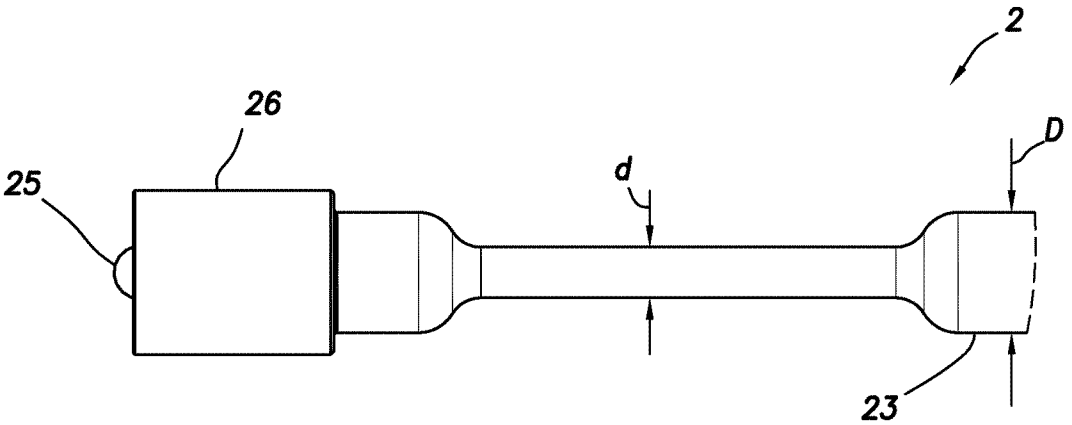
FIG. 7 is a representative side view of an example of an end link of the FIG. 6 weak link.
Figure 6:
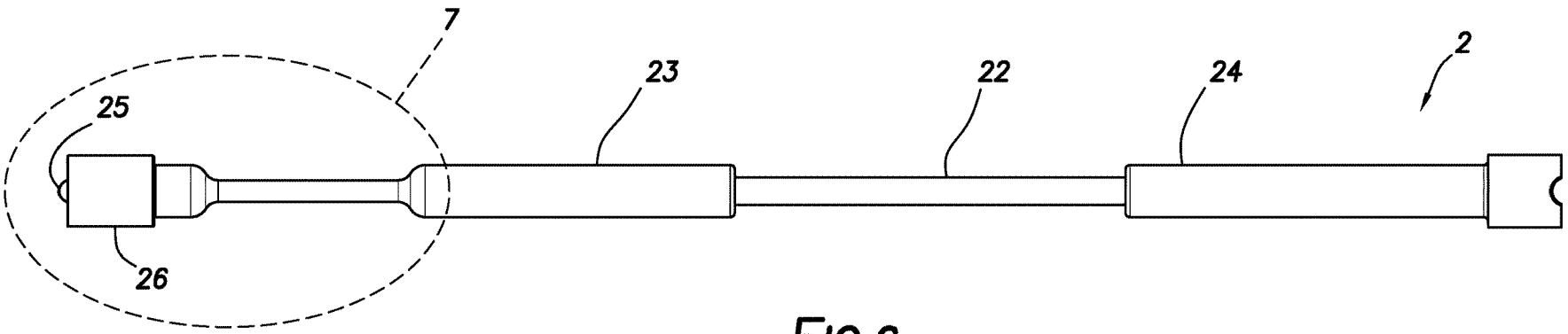
FIG. 6 is a representative side view of another example of the weak link.

Referring additionally now to FIGS. 6 & 7, another example of the weak link 2 is representatively illustrated. In this example, the upper end link 23 has been structurally modified to thereby modify a tensile strength of the upper end link.

As best viewed in FIG. 7, the upper end link 23 has been turned down (such as, using a lathe) to form a reduced diameter d on the upper end link. The diameter d is less than a diameter D of the upper end link 23 between the reduced diameter d and the wire rope 22.

In the FIGS. 6 & 7 example, the diameter d is positioned between an enlarged head 26 at an end of the upper end link 23 and a portion of the upper end link swaged to the wire rope 22. In other examples, the diameter d could be otherwise positioned. In addition, it is not necessary for the reduced diameter d to be formed on the upper end link 23 after the diameter D is formed on the upper end link (for example, the diameters d, D could be formed on the upper end link at the same time, or the diameter d could be formed first).

The diameter d is selected to result in a certain desired tensile strength of the upper end link 23. A material of the upper end link 23 can also be selected to provide a desired level of toughness and tensile strength to the upper end link. In this example, the tensile strength of the portion of the upper end link 23 having the reduced diameter d is less than the tensile strength of the wire rope 22 and less than that of the lower end link 24.

If it is instead desired for the lower end link 24 to comprise the weak point of the weak link 2, the lower end link can be designed to have a tensile strength that is less than that of the wire rope 22 and less than that of the upper end link 23. For example, the reduced diameter d could be formed on the lower end link 24. In this manner, the upper end link 23, the wire rope 22 and an upper portion of the lower end link 24 will remain in the cable head 106 when the lower end link parts in response to a predetermined tensile force being applied to the weak link 2.

It may now be fully appreciated that the above disclosure provides significant improvements to the art of designing, constructing and utilizing cable heads with weak links for use in wells. In examples described above, the weak link 2 can have a shock absorber (such as the wire rope 22) connected in series with a weak point (such as at the reduced diameter d), so that shock loads can be absorbed without breaking the weak link.

The above disclosure provides to the art a cable head 106 for use with a subterranean well. In one example, the cable head 106 can include an upper connector 21 configured to connect the cable head 106 to a wireline 104, a lower connector 8 configured to connect the cable head 106 to a well tool 105, and a weak link 2 configured to transmit tensile force between the upper and lower connectors 21, 8. The weak link 2 comprises a shock absorber (e.g., the wire rope 22) connected in series with a weak point (e.g., at the end link 23).

The wire rope 22 may be swaged to an end link 23, 24 of the weak link 2. The weak point may be formed on the end link 23, 24.

The weak point may comprise a reduced diameter d formed on an end link 23 of the weak link 2. The reduced diameter d may be positioned between an enlarged head 26 at an end of the end link 23 and a portion of the end link swaged to the shock absorber.

The weak point may have a tensile strength that is less than a tensile strength of the shock absorber.

Also provided to the art by the above disclosure is a method of connecting a wireline 104 to a well tool 105. In one example, the method can comprise: securing the wireline 104 to an upper end of a weak link 2, the weak link 2 comprising a wire rope 22, and first and second end links 23, 24 secured at respective opposite ends of the wire rope 22, the first end link 23 comprising a weak point; and securing the well tool 105 to a lower end of the weak link 2.

The method may include forming the weak point as a reduced diameter d on the first end link 23. The forming step may include forming the reduced diameter d longitudinally between an end of the first end link 23 and a portion of the first end link 23 swaged to the wire rope 22.

A diameter D of the portion of the first end link 23 swaged to the wire rope 22 may be greater than the reduced diameter d. A diameter D of the first end link 23 between the end of the first end link 23 and the reduced diameter d may be greater than the reduced diameter d.

The weak point may have a tensile strength that is less than a tensile strength of the wire rope 22.

A weak link 2 for use with a cable head 106 in a subterranean well is also described above. In one example, the weak link 2 can include a weak point and a shock absorber. The shock absorber is connected in series with the weak point.

The shock absorber may comprise a wire rope 22. The weak point may comprise a reduced diameter d formed on an end link 23 of the weak link 2.

The weak point may have a tensile strength that is less than a tensile strength of the shock absorber.

The reduced diameter d may be positioned longitudinally between an end of the end link 23 and a portion of the end link 23 swaged onto the shock absorber. The portion of the end link 23 swaged onto the shock absorber may have a diameter D that is greater than the reduced diameter d.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A cable head for use with a subterranean well, the cable head comprising:

an upper connector configured to connect the cable head to a wireline;

a lower connector configured to connect the cable head to a well tool; and a weak link configured to transmit tensile force between the upper and lower connectors, the weak link comprising an integral shock absorber secured between opposite ends of the weak link, in which the shock absorber is in series with a weak point of the weak link.

2. The cable head of claim 1, in which the shock absorber comprises a wire rope.

3. The cable head of claim 2, in which the wire rope is swaged to an end link of the weak link.

4. The cable head of claim 3, in which the weak point is formed on the end link.

5. The cable head of claim 1, in which the weak point comprises a reduced diameter formed on an end link of the weak link.

6. The cable head of claim 5, in which the reduced diameter is positioned between an enlarged head at an end of the end link and a portion of the end link swaged to the shock absorber.

7. The cable head of claim 5, in which the shock absorber comprises a wire rope.

8. The cable head of claim 1, in which the weak point has a tensile strength that is less than a tensile strength of the shock absorber.

9. A method of connecting a wireline to a well tool, the method comprising:

securing the wireline to an upper end of a weak link, the weak link comprising a wire rope, and first and second end links secured at respective opposite ends of the wire rope, the first end link comprising a weak point; and securing the well tool to a lower end of the weak link.

10. The method of claim 9, further comprising forming the weak point as a reduced diameter on the first end link.

11. The method of claim 10, in which the forming comprises forming the reduced diameter longitudinally between an end of the first end link and a portion of the first end link swaged to the wire rope.

12. The method of claim 11, in which a diameter of the portion of the first end link swaged to the wire rope is greater than the reduced diameter.

13. The method of claim 11, in which a diameter of the first end link between the end of the first end link and the reduced diameter is greater than the reduced diameter.

14. The method of claim 9, in which the weak point has a tensile strength that is less than a tensile strength of the wire rope.

15. A weak link for use with a cable head in a subterranean well, the weak link comprising:

a first end;

a second end opposite the first end;

a weak point; and a shock absorber secured between the first and second ends of the weak link, in which the shock absorber is in series with the weak point.

16. The weak link of claim 15, in which the shock absorber comprises a wire rope.

17. The weak link of claim 15, in which the weak point has a tensile strength that is less than a tensile strength of the shock absorber.

18. The weak link of claim 15, in which the weak point comprises a reduced diameter formed on an end link of the weak link.

19. The weak link of claim 18, in which the reduced diameter is positioned longitudinally between an end of the end link and a portion of the end link swaged onto the shock absorber.

20. The weak link of claim 19, in which the portion of the end link swaged onto the shock absorber has a diameter that is greater than the reduced diameter.

* * * * *